United States Patent [19]

Maddock

[11] Patent Number: 4,601,325

[45] Date of Patent: Jul. 22, 1986

[54] EXTRUSION

[75] Inventor: Brian Maddock, Broadstone, England

[73] Assignee: Alform Alloys Limited, Dorset, England

[21] Appl. No.: 553,967

[22] Filed: Nov. 21, 1983

[30] Foreign Application Priority Data

Nov. 26, 1982 [GB] United Kingdom ..... 8233820

[51] Int. Cl.[4] ..... B22D 11/00; B22D 11/12

[52] U.S. Cl. ..... 164/476; 164/76.1; 164/417

[58] Field of Search ..... 164/476, 417, 270.1, 164/477, 76.1; 148/2

[56] References Cited

U.S. PATENT DOCUMENTS 4,204,568 5/1980 Bonnamour ..... 164/482
4,393,917 7/1983 Fuchs, Jr. ..... 164/476

FOREIGN PATENT DOCUMENTS 1370894 10/1974 United Kingdom .
1590776 6/1981 United Kingdom .
2089703 6/1982 United Kingdom .

*Primary Examiner*—Nicholas P. Godici
*Attorney, Agent, or Firm*—Schwartz, Jeffery, Schwaab, Mack, Blumenthal & Evans

[57] ABSTRACT

Extrusion apparatus comprises a rotatable wheel having an endless groove in its periphery, a fixed structure which covers part of the groove to define a passageway, a blocking member projecting into the groove to close off one end of the passageway and a die orifice leading from the closed off passageway adjacent the blocking member. The metal which is introduced into the passageway at the position away from the blocking member is in molten form and means are provided for fluid cooling at least that part of the wall of the passageway which is not defined by the fixed structure so as to solidify molten metal introduced into the passageway.

6 Claims, 6 Drawing Figures

EXTRUSION

BACKGROUND OF THE INVENTION

This invention relates to the forming of a metal product by extrusion.

In British Patent Specification No. 1370894, there is described a method of, and apparatus for, continuously extruding metal. The apparatus comprises a rotatable wheel having an endless groove extending around its periphery, a fixed structure covering the groove along part of its length to define a passageway therewith, a blocking member projecting into the groove to close off one end of the passageway and a die orifice leading from the closed off passageway adjacent said blocking member. In use, the wheel is rotated relative to the fixed structure and metal rod to be extruded is fed into the end of the passageway away from the blocking member and the metal is carried along in the groove by frictional drag in the direction towards the blocking member and is forced through the die orifice to produce the metal product.

In this British specification, it is clear that it is intended that metal which is fed into the passageway is in the form of a solid rod, although there is a suggestion in the specification that the metal may be of powder form when it is introduced into the passageway. Clearly, when the metal to be extruded is in the form of a rod, then the rod has been made from molten metal elsewhere and has probably been rolled to the required cross-section and then transported to the extrusion apparatus.

SUMMARY OF THE INVENTION

It is an object of the present invention to provide a method of, and apparatus for, extruding a metal product which is both more compact and more efficient than known methods and apparatus.

According to a first aspect of the present invention, there is provided an extrusion apparatus which comprises a rotatable wheel having an endless groove extending around its periphery; a fixed structure covering the groove along part of its length to define a passageway therewith; a blocking member projecting into the groove to close off one end of the passageway and a die orifice leading from the closed off passageway adjacent said blocking member; characterised by the provision of means for introducing molten metal into the passageway at a position away from the blocking member, and means for fluid cooling at least that part of the wall of the passageway which is not defined by the fixed structure so as to solidify molten metal introduced into the passageway.

According to a second aspect of the present invention, in a method of extruding metal, the metal is introduced into one end of a passageway formed between a peripheral groove in a rotatable wheel and a fixed structure covering the groove along part of its length, and the wheel is rotated to force the metal through a die orifice leading from a closed off end of the passageway, characterised in that the metal is in molten form when it is introduced into the passageway and at least that part of the wall of the passageway which is not defined by the fixed structure is fluid cooled to cause the molten metal to solidify before it is forced through the die orifice.

The present invention is thus more efficient than the prior art in that molten metal is introduced into the passageway and it is cooled sufficiently for it to solidfy before it is forced out of the die orifice, but the solidified metal is at an extrusion temperature when it reaches the die orifice and, consequently, the power required to force it out through the die orifice is much less than is the case when the metal is introduced into the passageway in the form of a cold rod. Much of the energy required in the prior art arrangement to roll the rod to the required dimensions prior to introducing it into the passageway is avoided with the present invention.

The present invention is more compact than the prior art arrangement because the means for introducing the molten metal into the passageway and for extruding the metal through the die orifice is contained within the one piece of apparatus rather than in several pieces of apparatus in different locations.

In one embodiment of the present invention, both the rotatable wheel and the fixed structure are fluid cooled so that substantially all the wall of the passageway is cooled and this causes the molten metal to solidify rapidly and to form a hardened skin in contact with the entire wall of the passageway. The skin initially encloses a pasty core but this core has solidifed before the metal is forced out of the die orifice. Although the skin of the solidified metal is not in contact with air and does not, therefore, have surface impurities, it has been found that the metal constituting the outer skin has better metallurgical properties than that constituting the central core of the solidified metal. With this embodiment, all of the metal is forced through the die orifice and that initially forming the core of the solidified metal is distributed throughout the extruded product.

In an alternative embodiment of the invention, only the part of the wall of the passageway which is not defined by the fixed structure is cooled and this means that a solidified skin is formed in contact with the wall of the passageway provided by the rotating wheel while more molten metal remains in contact with the uncooled wall provided by the fixed structure. By rotating the wheel at a faster rate than is employed in the earlier embodiment, the recently formed solidified skin can be dragged off the still pasty metal in the passageway and is compressed at the end of the passageway against the blocking member prior to this skin being extruded through the die orifice. After the skin has been drawn off the pasty metal, some of this pasty metal then comes into contact with the cooled wheel to form a new skin while molten metal flows into the space in contact with the fixed structure from which the newly formed skin has been taken. In this way, only the solidified skin is used to form the extruded product and, as a result, the product has improved metallurgical properties.

In order that the invention may be more readily understood, it will now be described, by way of example only, with reference to the accompanying drawings, in which:

DETAILED DESCRIPTION OF THE PREFERRED EMBODIMENTS

Figure 1:
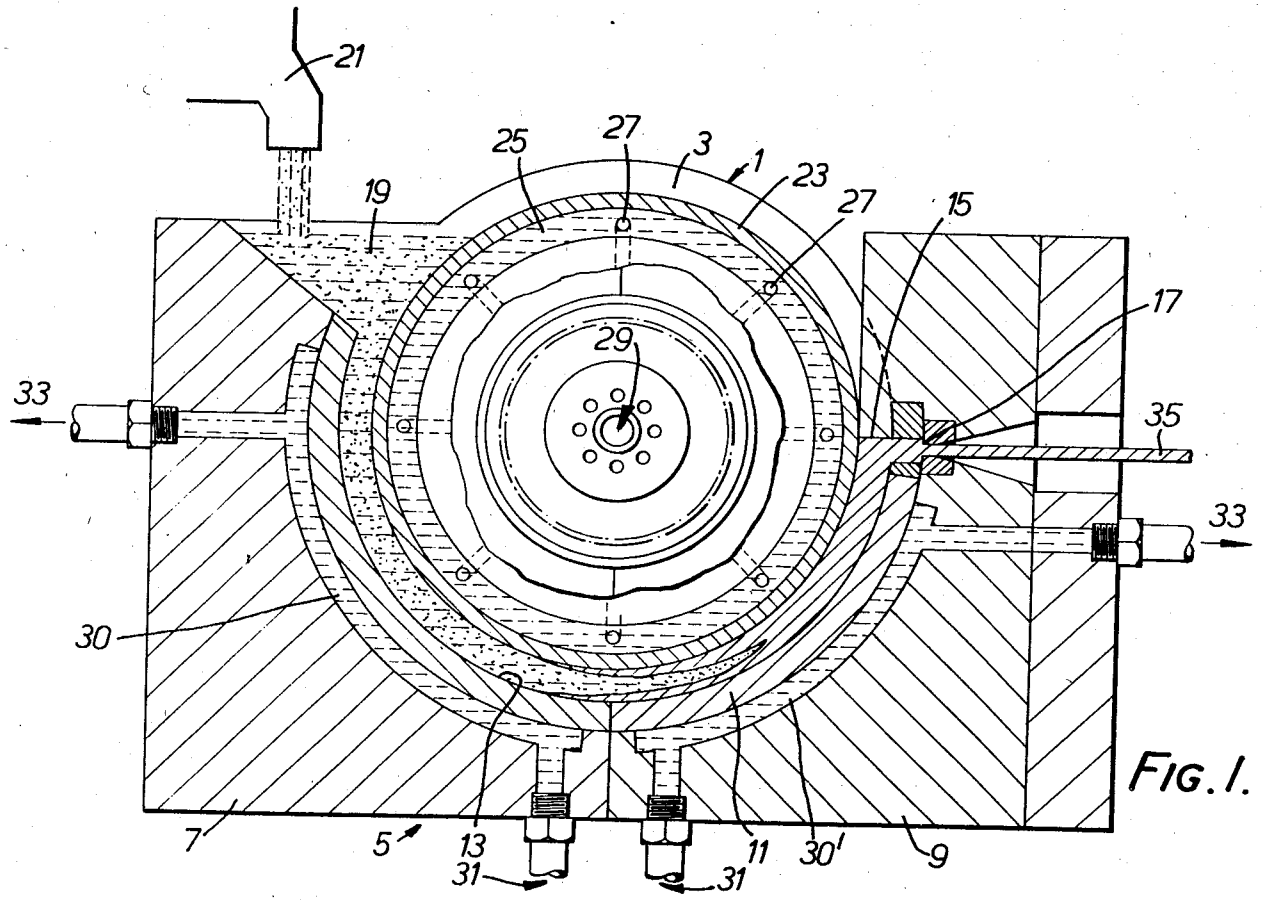
FIG. 1 is a sectional side elevation of apparatus in accordance with one embodiment of the invention.

The present extrusion apparatus comprises a wheel 1 having an endless peripheral groove 3. The wheel is in two parts secured together and is rotatable about a horizontal axis in bearings (not shown) in a fixed structure 5 consisting mainly of two parts 7 and 9 which are secured together. The structure 5 provides a curved metal plate 11 made up of two parts and positioned below the wheel but which covers the groove 3 along part of its length and forms a passageway 13 with the groove. The part 9 includes a blocking member 15 which projects into the groove 3 in the wheel to close off one end of the passageway. At this end of the passageway, a die orifice 17 provides an exit from the closed off end of the passageway. The other end of the passageway leads to a reservoir 19 formed by the structure 5 and into which molten metal is poured from a tundish 21. The molten metal flows into the passageway and completely fills it.

The bottom wall of the groove 3 in the wheel is provided by an annular ring 23 and the inside surface of this ring is in contact with coolant, conveniently water, in a passageway 25. The coolant is introduced into this passageway through a number of radially extending bores 27 in one part of the wheel and connected to a pipe 29 extending along the axis of the wheel through one of the hubs supporting the wheel. The coolant returns along a number of radially extending bores 40 on the other part of the wheel into a tube 41 which surrounds part of the pipe 29.

Figure 2:
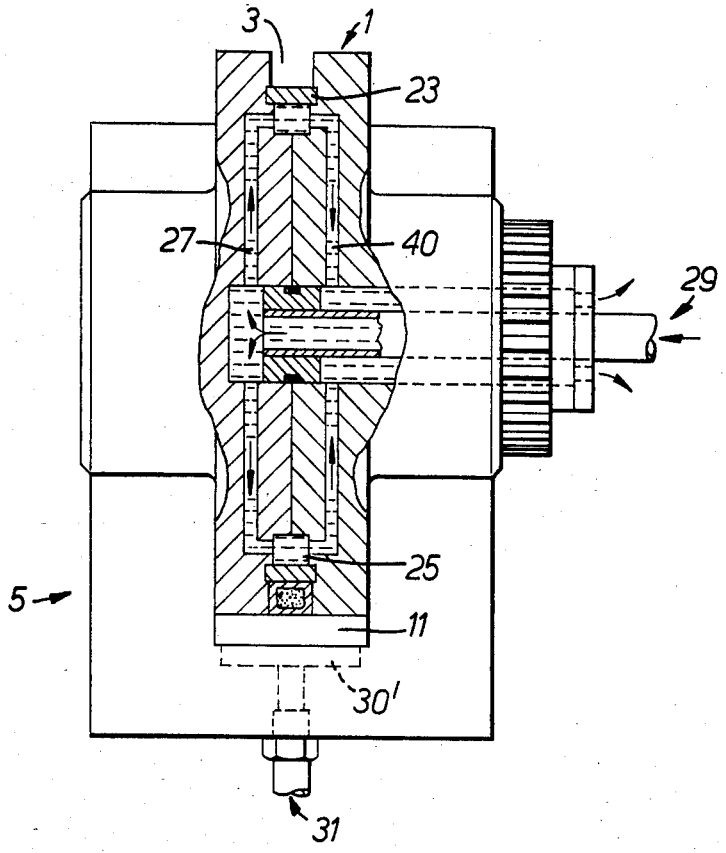
FIG. 2 is a sectional end elevation of the apparatus shown in FIG. 1.

In the embodiment shown in FIGS. 1 and 2, the plate 11 is supported by the structure 5 with the surface of the plate which is away from the passageway 13 being contacted by coolant flowing through passages 30, 30' formed in the parts 7, 9, respectively, and connected through entry and exit ports 31, 33, respectively.

In use, the wheel is rotated about its axis within the fixed structure 5 by a motor (not shown) in driving relation with the wheel. Coolant is supplied to the pipe 29 and flows to the passageway 25 where it cools the annular ring 23. Similarly, liquid coolant is introduced into the inlet ports 31 to thereby flow through the passages 30, 30' to cool the body 11. Molten metal, conveniently aluminium or an aluminium alloy, is poured from the tundish 21 into the reservoir 19 and into the inlet end of the passageway 13. The molten metal comes into contact with the chilled walls defining the passageway and the metal solidifies before it reaches the closed off end of the passageway. The movement of the wheel forces the now solidified metal against the blocking member 15 and forces the metal through the die orifice 17 to form an extruded product 35.

Figure 3:
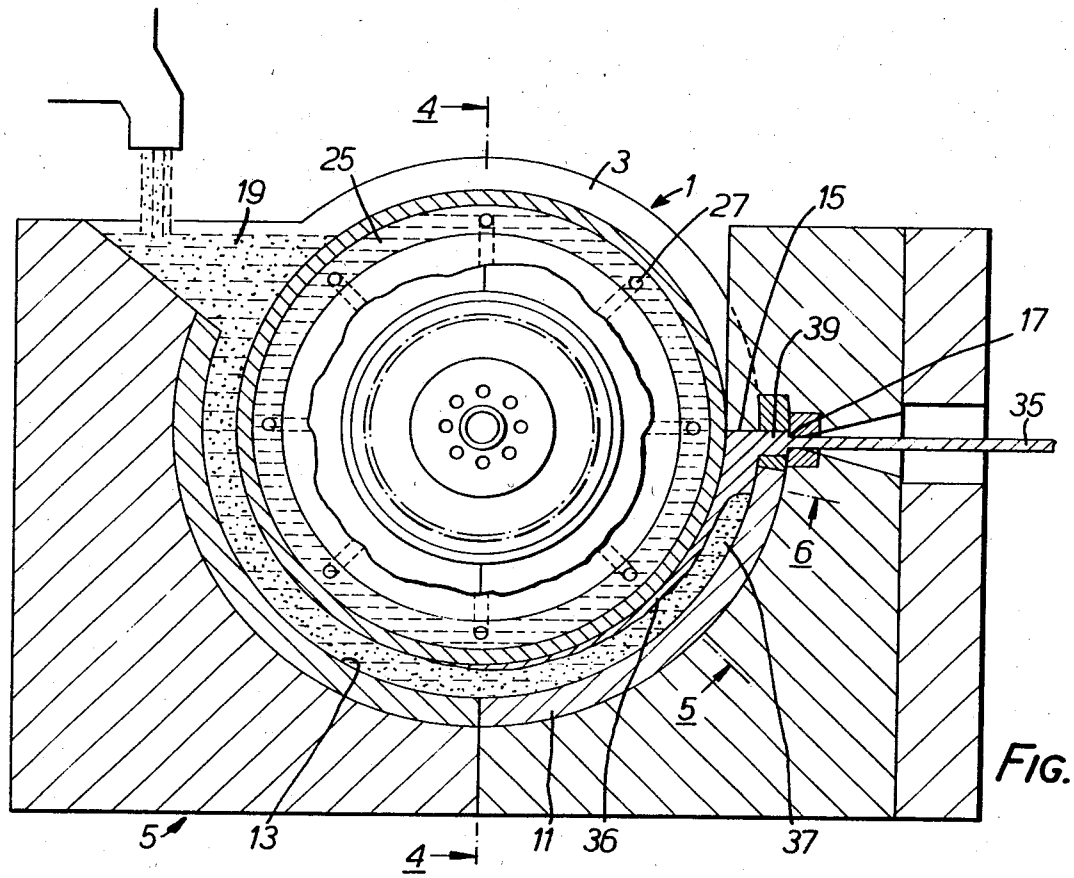
FIG. 3 is a sectional side elevation of an alternative embodiment of the invention.
Figure 4:
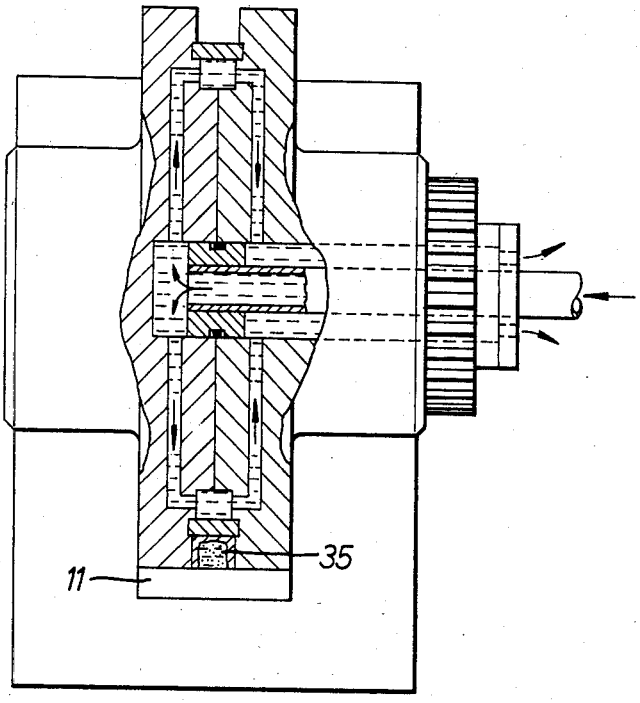
FIG. 4 is a sectional end elevation of the line 4—4 shown in FIG. 3.
Figure 5:
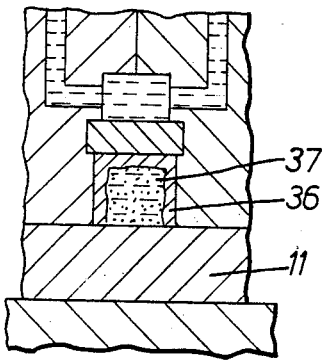
FIGS. 5 and 6 are sectional views of the apparatus taken along the lines 5—5 and 6—6, respectively, of FIG. 3.
Figure 6:
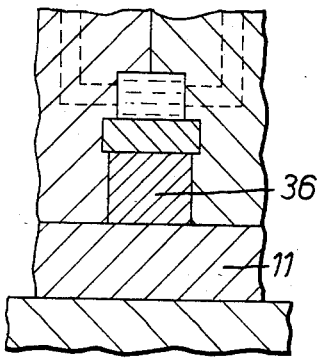

In the arrangement shown in FIGS. 3 to 6, the extrusion apparatus is the same as that shown in FIGS. 1 and 2, except that the part of the passageway 13 defined by the plate 11 is not fluid cooled. In other words, the passages 30, 30' are not present. The molten metal flowing from the tundish 19 into the passage 13 commences to solidify where it contacts the cooled wall of the passageway provided by the wheel 1, but it does not readily solidify where it is in contact with the part of the passageway defined by the plate 11. The solidified skin 36 is shown in FIG. 3 beginning to form closer to the blocking member 15 than in the arrangement shown in FIG. 1. This is because the wheel 1 is rotated at a higher speed than that shown in FIG. 1 so that the cooling effect on the molten metal is reduced as compared with the arrangement shown in FIG. 1, and also the frictional drag on the solidified skin 36, due to the rotation of the wheel 1, causes the skin to be drawn off the pasty material 37 present in the passageway and the drawn off skin is compressed into the space 39 close to the blocking member 15. This solidified metal is then forced out of the die orifice 17 to form the product 35. With this arrangement, the metal which solidifies to form the skin has superior metallurgical properties than the metal which forms the pasty core of the solidified metal and it is this skin which is continuously dragged off the pasty core and used to produce the product 35. As the skin is drawn off, the pasty core comes into contact with the cooled wheel and forms a new skin due to the pressure of the molten metal in the tundish 19.

Tests have shown that, with a wheel of 260 millimeters diameter rotated at 5 revolutions per minute, complete solidification takes place over an arc of about 130° but, by rotating the wheel at 10 revolutions per minute, the metal in the passageway cannot solidify completely across its cross section and only that part at the side of the passageway where it contacts the wheel is solidified to form a skin and this is continuously sheared off the layer of metal on the walls of the groove and forms a build up of a slug of solid metal in front of the block member. The length of this slug is determined by the pressure required to extrude the metal through the extrusion die and the slug length is inversely proportional to the required pressure.

The rate of cooling and, therefore, the rate of solidification is proportional to the thickness of the layer of material already solidified on the wall of the groove. The heat flow is proportional to the difference between the solidification temperature of the molten metal and the temperature of the wall of the groove of the wheel, divided by the thickness of the solidified layer. Thus, the material on the surface solidifies at a rate many times faster than that at the center of the groove.

This technique of extruding from the continuously collected thin layer has several advantages.

Firstly, the solidified layer will have a smaller grain size than that which would exist at the central area of a workpiece solidified across the whole cross section of the groove and, therefore, the collection of a uniform layer of small grain material to produce the extruded product will result in a product of uniform grain size.

Secondly, the segregation of the alloying elements from a molten metal alloy will be reduced both on the macroscopic and microscopic scale. This is due to the fact that the extruded product is produced from a thin layer of solidified alloy in which there is no variation in segregation through the cross section but that a variation in the segregation would exist if the product was produced from a completely cast workpiece.

In an alternative arrangement, the wheel is rotated about a horizontal axis, the molten metal is poured into the passageway at a position substantially vertically above the axis and the die orifice is positioned at one side of the axis at substantially the same vertical height as the axis.

It has been found that, with the arrangements according to the present invention, difficulties which occur in the prior art arrangement, due to surface impurities on the solid metal which is introduced into the passageway, are eliminated and also a considerable amount of energy is saved in that the metal does not have to be first formed into a rod before it is then introduced cold into the passageway and, furthermore, when the metal does reach the die orifice, its temperature will be close to its extrusion temperature and the work which is put into rotating the wheel from an external source to extrude the metal is corrspondingly reduced.

What is claimed is:

1. An extrusion apparatus, comprising:

a wheel rotatable about a horizontal axis and having an endless groove extending around its periphery;

a fixed structure covering said groove along part of the length of said groove to define a passageway therebetween;

a blocking member which projects into said groove to close one end of said passageway;

a die orifice supported by the structure and leading from the closed passageway adjacent said blocking member to the exterior of said passageway;

means for rotating said wheel relative to said fixed structure;

means for introducing molten metal into said passageway at a position away from said blocking member; and means for fluid cooling only the portion of the wall of said passageway defined by said wheel to cause said metal to form a pasty semi-solid material having a solidified skin in the area of contact with said cooled wall.

2. An extrusion apparatus as claimed in claim 1, wherein said rotating means comprises means for rotating said wheel at a speed sufficient to draw said solidified skin from said pasty semi-solid material.

3. Extrusion apparatus as claimed in claim 1, including a metal ring located in the groove away from the bottom of the groove and wherein said fluid cooling means includes a plurality of bores leading to and from the space between the bottom of the groove and the metal ring.

4. Extrusion apparatus as claimed in claim 1, in which the passageway passes beneath said axis and the blocking member and a tundish for introducing molten metal into the passageway are located on opposite sides of the axis.

5. A method for extruding metal in an apparatus having a passageway formed between an endless peripheral groove of a wheel which is rotatable about a horizontal axis and a fixed structure co-operating with the wheel to cover the groove along a part of its length, comprising the steps of:

continuously introducing molten metal into one end of the passageway;

rotating the wheel in a direction such that its periphery moves along the length of the passageway towards a blocking member which projects into the groove and closes the end of the passageway opposite said molten metal introducing end;

fluid cooling only the portion of the wall of the passageway defined by the wheel, wherein said metal forms a pasty semi-solid material having a solidified skin in the area of contact between the metal and the cooled wall; and selecting the rotation speed of the wheel such that the wheel draws the solidified skin from the pasty semi-solid material and transports the skin to the blocking member.

6. A method for extruding metal in an apparatus having a passageway formed between an endless peripheral groove of a wheel which is rotatable about a horizontal axis and a fixed structure co-operating with the wheel to cover the groove along a part of its length on the underside of the wheel with the passageway extending below the axis of rotation of the wheel, comprising the steps of:

continuously introducing molten metal into one end of the passageway;

rotating the wheel in a direction such that the underside of the wheel moves towards a blocking member which projects into the groove and closes the end of the passageway opposite said molten metal introducing end;

fluid cooling only the portion of the wall of the passageway defined by the wheel, wherein said metal forms a pasty semi-solid material having a solidified skin in the area of contact between the metal and the cooled wall; and selecting the rotation speed of the wheel such that the wheel draws the solidified skin from the pasty semi-solid material and transports the skin to the blocking member.

* * * * *